US010008359B2

(12) United States Patent
Canfield et al.

(10) Patent No.: US 10,008,359 B2
(45) Date of Patent: Jun. 26, 2018

(54) X-RAY TUBE HAVING MAGNETIC QUADRUPOLES FOR FOCUSING AND MAGNETIC DIPOLES FOR STEERING

(71) Applicant: VAREX IMAGING CORPORATION, Salt Lake City, UT (US)

(72) Inventors: Bradley D. Canfield, Orem, UT (US); Colton B. Woodman, West Valley City, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 512 days.

(21) Appl. No.: 14/642,283

(22) Filed: Mar. 9, 2015

(65) Prior Publication Data

US 2016/0268095 A1 Sep. 15, 2016

(51) Int. Cl.

| | |
|---|---|
| ***H01J 35/14*** | (2006.01) |
| ***H01J 35/30*** | (2006.01) |
| ***H01J 35/06*** | (2006.01) |
| *H01J 35/26* | (2006.01) |

(52) U.S. Cl.

CPC ..... *H01J 35/14* (2013.01); *H01J 35/06* (2013.01); *H01J 35/305* (2013.01); *H01J 35/26* (2013.01)

(58) Field of Classification Search

CPC ..... H01J 35/14; H01J 35/30; H01J 35/305
See application file for complete search history.

(56) References Cited

U.S. PATENT DOCUMENTS 3,201,631 A 8/1965 Gale et al.
3,743,836 A * 7/1973 Holland ..... H01J 35/06 378/106

(Continued)

FOREIGN PATENT DOCUMENTS

JP S5423492 A 2/1979
WO 2008/044194 A2 4/2008

OTHER PUBLICATIONS

Translation of JP 54023492 published Feb. 22, 1972.*
International Search Report and Written Opinion dated Jun. 14, 2016, in PCT Application No. PCT/US2016/021232 (14 pages).

*Primary Examiner* — Glen Kao
(74) *Attorney, Agent, or Firm* — Maschoff Brennan

(57) ABSTRACT

An X-ray tube can include: a cathode including an electron emitter; an anode configured to receive the emitted electrons; a first magnetic quadrupole between the cathode and the anode and having a first quadrupole yoke with four first quadrupole pole projections extending from the first quadrupole yoke and oriented toward a central axis of the first quadrupole yoke and each of the four first quadrupole pole projections having a first quadrupole electromagnetic coil; a second magnetic quadrupole between the first magnetic quadruple and the anode and having a second quadrupole yoke with four second quadrupole pole projections extending from the second quadrupole yoke and oriented toward a central axis of the second quadrupole yoke and each of the four second quadrupole pole projections having a second quadrupole electromagnetic coil; and a magnetic dipole between the cathode and anode and having a dipole yoke with four dipole electromagnetic coils.

21 Claims, 13 Drawing Sheets

(56) References Cited

U.S. PATENT DOCUMENTS

| | | | | |
|---|---|---|---|---|
| 4,130,759 | A * | 12/1978 | Haimson | H01J 35/14 378/137 |
| 2010/0020937 | A1* | 1/2010 | Hautmann | H01J 35/30 378/137 |
| 2012/0177185 | A1* | 7/2012 | Koppisetty | H01J 35/14 378/137 |
| 2012/0281815 | A1 | 11/2012 | Ferger et al. | |
| 2013/0051532 | A1* | 2/2013 | Caiafa | H01J 35/18 378/110 |
| 2014/0010354 | A1* | 1/2014 | Lemaitre | H01J 35/06 378/136 |
| 2015/0178536 | A1 | 7/2015 | Canfield et al. | |

* cited by examiner

X-RAY TUBE HAVING MAGNETIC QUADRUPOLES FOR FOCUSING AND MAGNETIC DIPOLES FOR STEERING

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

In certain applications, it may be beneficial to lengthen the throw length of an X-ray tube. The throw length is the distance from cathode electron emitter to the anode surface. For example, a long throw length may result in decreased back ion bombardment and evaporation of anode materials back onto the cathode. While X-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. Also affected is the ability to properly focus and/or position the electron beam towards the anode target, again resulting in a less than desirable focal spot—either in terms of size, shape and/or position. When a focal spot is unacceptable, it may be difficult to produce useful X-ray images.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size and position on an anode target. This helps to increase spatial resolution or to reduce artifacts in resulting images.

Certain embodiments include a magnetic system implemented as two magnetic quadrupole cores and one magnetic dipole core disposed in the electron beam path of an X-ray tube. The quadrupole cores are configured to focus in both directions perpendicular to the beam path. The two quadrupole cores form a magnetic lens (sometimes referred to as a "doublet") and the focusing is accomplished as the beam passes through the quadrupole lens. The primary steering function is accomplished by offsetting the coil current in corresponding magnetic pairs of the dipole (e.g., two orthogonal dipole pairs) which results in an overall shift in the magnetic field to nudge the electrons in a certain direction. Steering of the beam occurs through appropriate coil pair energizing of both dipole coil pairs, and can be done in one axis or a combination of axes.

In one example, one quadrupole is used to focus in the first direction and the second quadrupole to focus in the second direction and the dipole is used to steer in both directions. Additionally, the dipole core can be configured for two axis beam steering. In one aspect, the dipole core can be configured for high dynamic response. This provides three separate cores, one for focusing in the width (e.g., $1^{st}$ quadrupole core), one for focusing in the length (e.g., $2^{nd}$ quadrupole core), and one for beam steering (e.g., dipole core).

Certain embodiments include a magnetic system implemented as two magnetic quadrupoles and two magnetic dipoles disposed in the electron beam path of an X-ray tube. The two magnetic quadrupoles are configured to focus the electron beam path in both directions perpendicular to the beam path. The two magnetic dipoles are collocated on a common dipole core and configured to steer the beam in both directions perpendicular to the beam path, which can provide four quadrant steering. The two quadrupoles form a magnetic lens (sometimes referred to as a "doublet") and the focusing is accomplished as the beam passes through the quadrupole lens. The steering is accomplished by the two dipoles which are created by coils wound on the dipole core pole protrusions. The focusing is accomplished by the quadrupole coils being wound on the quadrupole pole protrusions of the two quadrupole cores so as to maintain the focusing coil current. Steering of the beam occurs through appropriate dipole coil pair energizing and can be done in one axis or a combination of axes perpendicular to the electron beam path. In one embodiment, one quadrupole is used to focus in the first direction and the second quadrupole to focus in the second direction, and the dipole is used to steer the electron beam in both directions.

In yet another embodiment, an electron source is provided in the form of an electron emitter, such as a flat emitter, for the production of electrons. The emitter has a relatively large emitting area with design features that can be tuned to produce the desired distribution of electrons to form a primarily laminar beam. The emission over the emitter surface is not uniform or homogenous; it is focused and steered with the quadrupole and dipole cores to meet the needs of a given application. As the beam flows from the cathode to the anode, the electron density of the beam spreads the beam apart significantly during transit. The increased beam current levels created by higher power requirements exacerbate the spreading of the beam during transit. In disclosed embodiments, to achieve the focal spot sizes required, the beam is focused by two quadrupoles and then steered by the two dipoles as it transits from the cathode to the anode. This also provides for creating a multiplicity of sizes from a single emitter; the size conceivably could be changed during an exam as well. This allows for the focal spot to be changed on the fly. The increased emitter area of the flat and planar geometry of the emitter allows production of sufficient electrons flowing laminarly to meet the power requirements. To address the requirement of steering the beam in two dimensions so as to provide the desired imaging enhancements, a pair of magnetic dipoles is used to deflect the beam to the desired positions at the desired time. One dipole pair set is provided for each direction.

In sum, proposed embodiments provide a flat emitter with tunable emission capabilities as an electron source. The embodiment also utilizes two quadrupoles to focus the beam in two dimensions to a multiplicity of sizes. Further, two dipole pairs can be used to steer the beam to positions for enhanced imaging performance.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
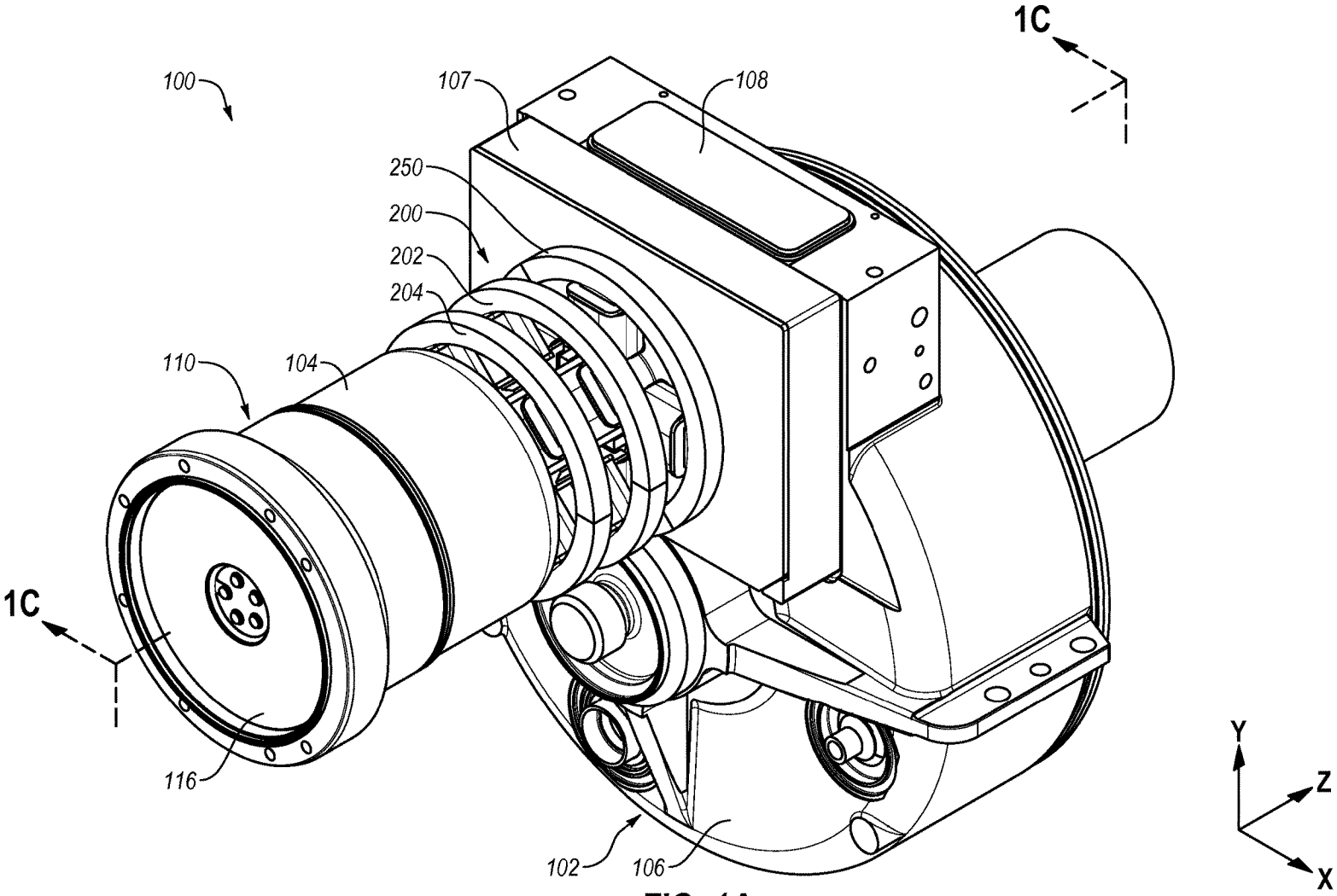
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Embodiments of the present technology are directed to X-ray tubes of the type having a vacuum housing in which a cathode and an anode are arranged. The cathode includes an electron emitter that emits electrons in the form of an electron beam that is substantially perpendicular to a face of the emitter, and the electrons are accelerated due a voltage difference between the cathode and the anode so as to strike a target surface on the anode in an electron region referred to as a focal spot. Embodiments can also include an electron beam focusing component and steering component that is configured to manipulate the electron beam by: (1) deflecting, or steering, the electron beam, and thereby altering the position of the focal spot on the anode target; and (2) focusing the electron beam so as to alter the length and width dimensions of the focal spot. Different embodiments utilize different configurations of such focusing components and steering components, such as magnet systems, including combinations of electromagnets formed as quadrupoles and as dipoles via coil elements with current flowing therein and disposed on a carrier/yoke comprised of a suitable material. The X-ray tube can include focusing components and steering components, and can selectively use the focusing components and/or steering components in different X-ray methodologies.

The embodiments can include an electron beam focusing component that includes two magnetic quadrupole cores. Each magnetic quadrupole core can have a yoke with four pole protrusions evenly distributed therearound, and each pole protrusion can include an electromagnetic element so that all four electromagnets provide the quadrupole core. One quadrupole core can narrow the electron beam in the length direction, and the other quadrupole core can narrow the electron beam in the width direction. Thereby, the combination of the two quadrupole cores can cooperate to focus the electron beam, which allows precise length and width dimension control of the focal spot on the anode. However, either or both quadrupole cores can focus in the length and width directions.

Figure 1B:
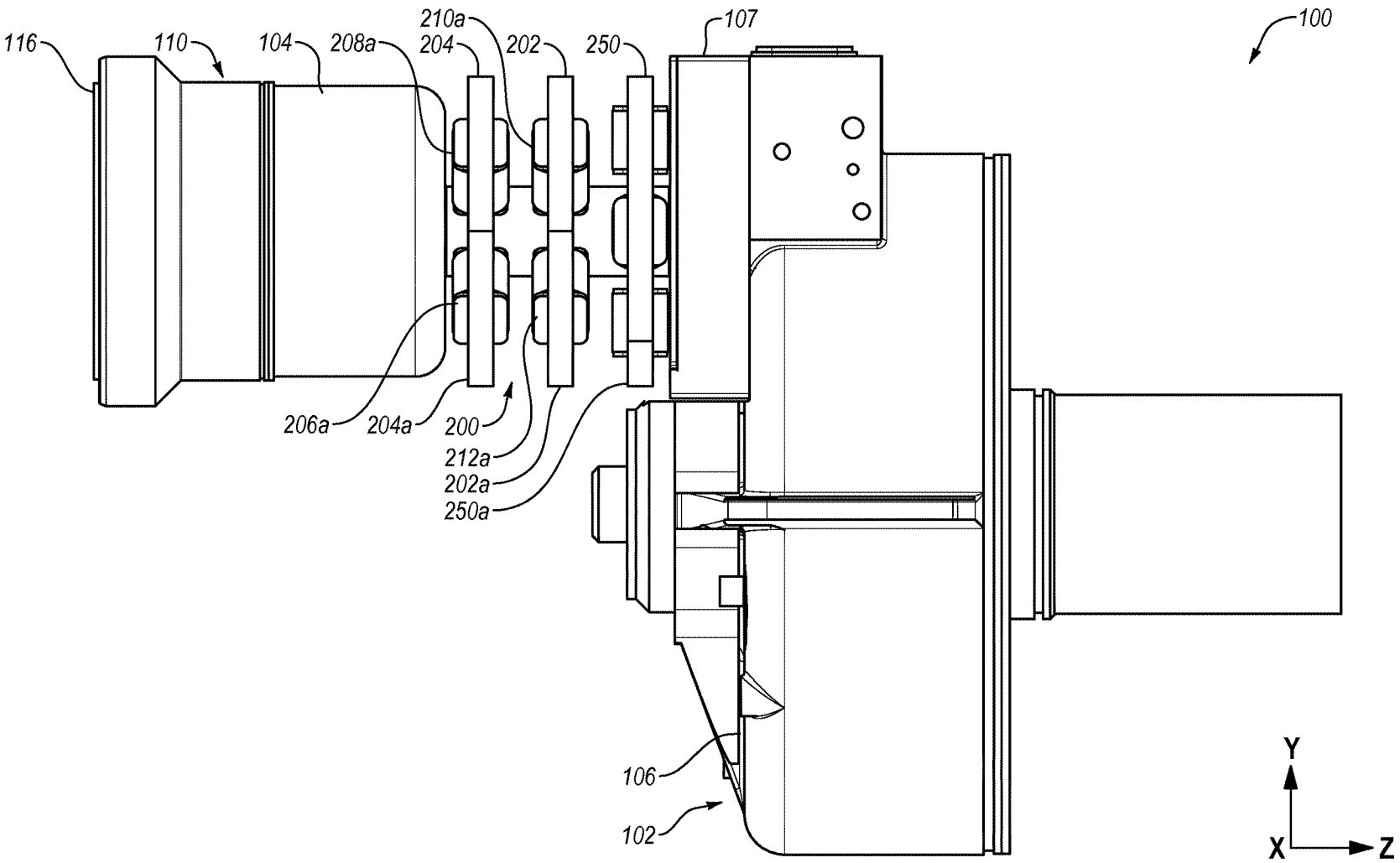
FIG. 1B is a side view of the X-ray tube of FIG. 1A.
Figure 1C:
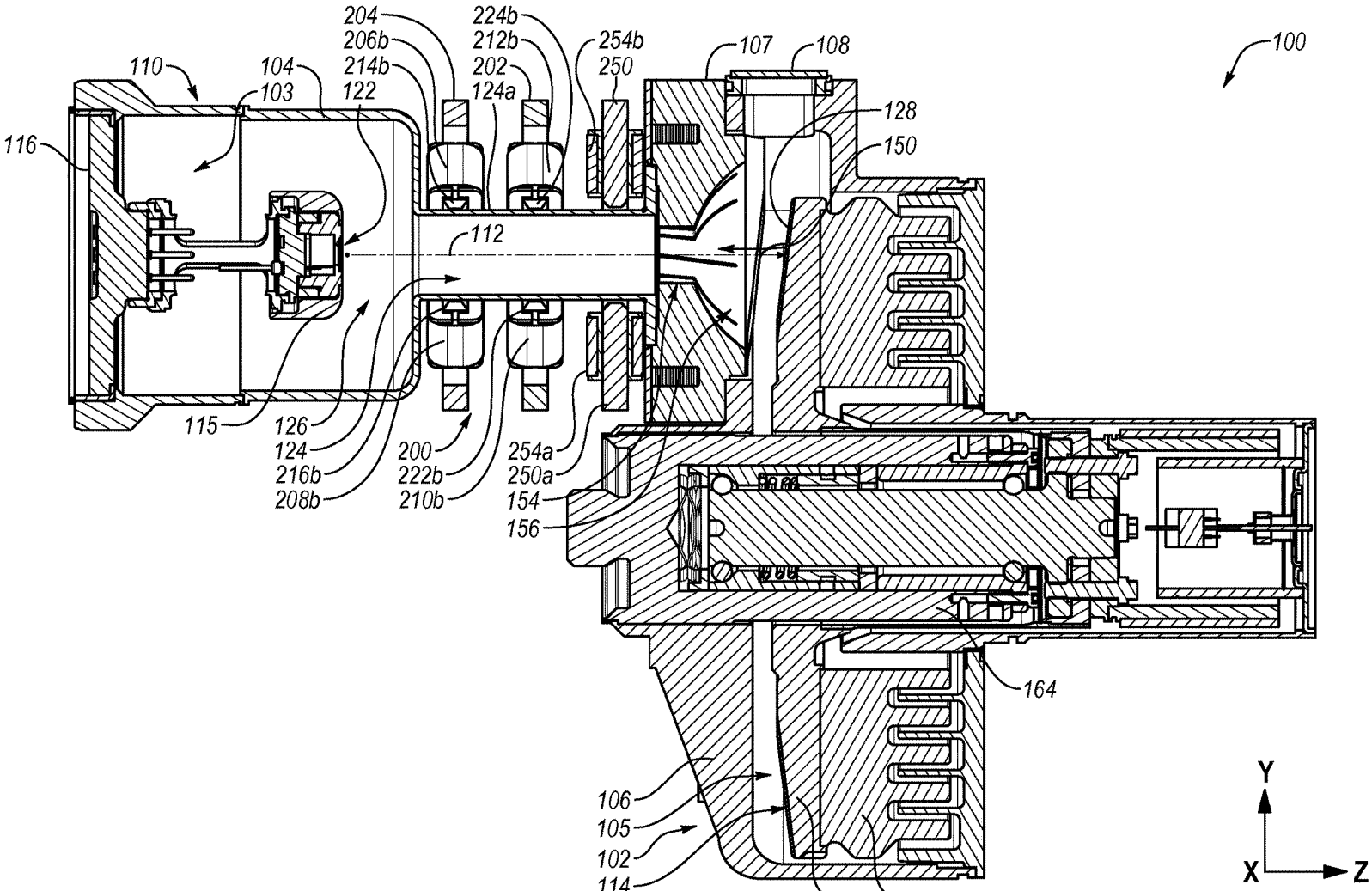
FIG. 1C is a cross-sectional view of the X-ray tube of FIG. 1A.

The embodiments can include an electron beam steering component that includes one magnetic dipole core that has two different dipole pairs. The dipole core can have a yoke with four electromagnets evenly distributed therearound so as to form two dipole pairs that are orthogonal. The electromagnets can be wound around the yoke, or alternatively the electromagnetics can be wound around pole protrusions on the yoke. The dipole core can steer the electron beam in any direction or toward any quadrant. The dipole core can impart a magnetic field that nudges and deflects the electron beam, and then the electron beam coasts to the target anode. This gives precise location control for the spot. One example of an X-ray tube can have certain of these features—discussed in further detail below—is shown in FIGS. 1A-1C.

In one embodiment, the ray-tube can be included in an X-ray system, such as a CT system, and can include electron beam control. The X-ray tube can have high power with focusing and 2-dimensional beam movement controllability with a short or a long throw between the cathode and anode. The X-ray tube can control the beam to a defined focal spot area or shape or location. The X-ray tube can steer the electron beam in two dimensions under active beam manipulation by a dipole core having two dipoles, any alone or in any combination. Such beam steering can be implemented in imaging methods to provide a richer CT data set, where the rich CT data set can be used to improve resolution of an image from the CT. The improved resolution can improve resolution in the slice and row directions of the CT, for example, as per being received (e.g., seen) by the detector.

In one embodiment, the cathode emits an electron beam that flows from the cathode toward the anode such that the beam spreads the electrons apart during transit, and one or more of the quadrupole cores focus the electron beam to a defined focal spot. In one aspect, both quadrupole cores provide a focusing effect on the electron beam. This allows for both beam width (e.g., X axis) and beam length (e.g., Y axis) focusing, wherein one quadruple core focuses in the length and the other quadrupole core focuses in the width. This also allows for the ability of the X-ray tube to create a plurality of different types of focal spot sizes and shapes from a single planar emitter, where such changes of focusing and change of beam length and/or width can be performed during imaging, such as during a CT examination. However, movement of the X-ray in the Z axis may be desirable, and due to the angle of the anode target surface, steering of the electron beam in the X axis and/or Y axis can cause the X-ray to move in the Z axis.

In one embodiment, the X-ray tube can perform beam focusing with high magnetic flux in a small throw volume or space. The magnetic material suitable for high magnetic flux can be a material that does not saturate can be used for the quadrupole cores in the yokes, such as the yokes for two adjacent quadruple cores. Also, the quadrupole pole projections can be the same material as the yoke. Such a material can be iron.

In one embodiment, the dipole core can include a magnetic material that has high dynamic response, which material can be used for the yoke. The material can have less magnetic flux than the material of the quadrupole cores. The material of the dipole core can be configured so that it does not saturate at low levels, and it responds several orders of magnitude faster than the iron material used for the quadrupole cores. The dipole core material can be iron based ferrite with higher flux capacity, which allows for a smaller size core. The material allows up to 7 kHz switching and as low as about 20 microseconds transitions. In one aspect the dipole core material can be a ferrite material. The ferrite can be an iron ceramic, such as iron oxide, which can have different magnetic characteristics compared to the quadrupole core material. The material of the quadrupole cores can be iron. However, one quadrupole core can include the ferrite material.

In one embodiment, the X-ray tube having the two quadrupole cores and one dipole core can be configured for high flux in the two quadrupole cores and fast response in the one dipole core. Thus, the dipole core material can be different from the quadrupole core material. The same material can be used for the yoke and the pole protrusions.

The dipole core can include pole protrusions that have coils wrapped therearound for the electromagnets. On the other hand, the dipole core can include the coils wrapped around the annular body of the core at different and opposing locations, where coils wrapped around the annular body can be between pole protrusions, if pole protrusions are included. In one aspect, the dipole core can be devoid of coils on pole protrusions, and the magnetic coils can be wrapped at four locations around the yoke. The dipole core can have the magnetic members staggered from the electromagnets of the quadrupole cores, such as at 45 degrees therefrom.

In one embodiment, the X-ray tube having the two quadrupole cores and one dipole core can be separated from each other such that focusing quadrupole cores are separate from the steering dipole core. The beam steering can be operated as higher rates, such as in the kHz range. The X-ray can provide the user with enhanced imaging and more capability to enrich the CT data sets with reduced radiation dose. This can allow the X-ray tube to be used in advanced imaging methods. This can also include the X-ray tube to perform higher flux focusing with the focusing cores to create small focal spots without saturation in the core material.

In one embodiment, the X-ray can include the two quadrupoles having the pole protrusions and the electromagnets aligned, which can be referenced at 0, 90, 180, and 270 degrees. The dipole core can have the electromagnets staggered from those of the quadrupole cores, which staggering can result in the electromagnets being at about 45, 135, 225, and 315 degrees.

In one embodiment, the X-ray can include 0 degrees on an axis, and the two quadrupoles having the pole protrusions and the electromagnets aligned, which can be referenced at 45, 135, 225 and 315 degrees. The dipole core can have the electromagnets staggered from those of the quadrupole cores, which staggering can result in the electromagnets being at about 0, 90, 180, and 27 degrees. This can be seen in FIGS. 2C and 5A.

Figure 5A:
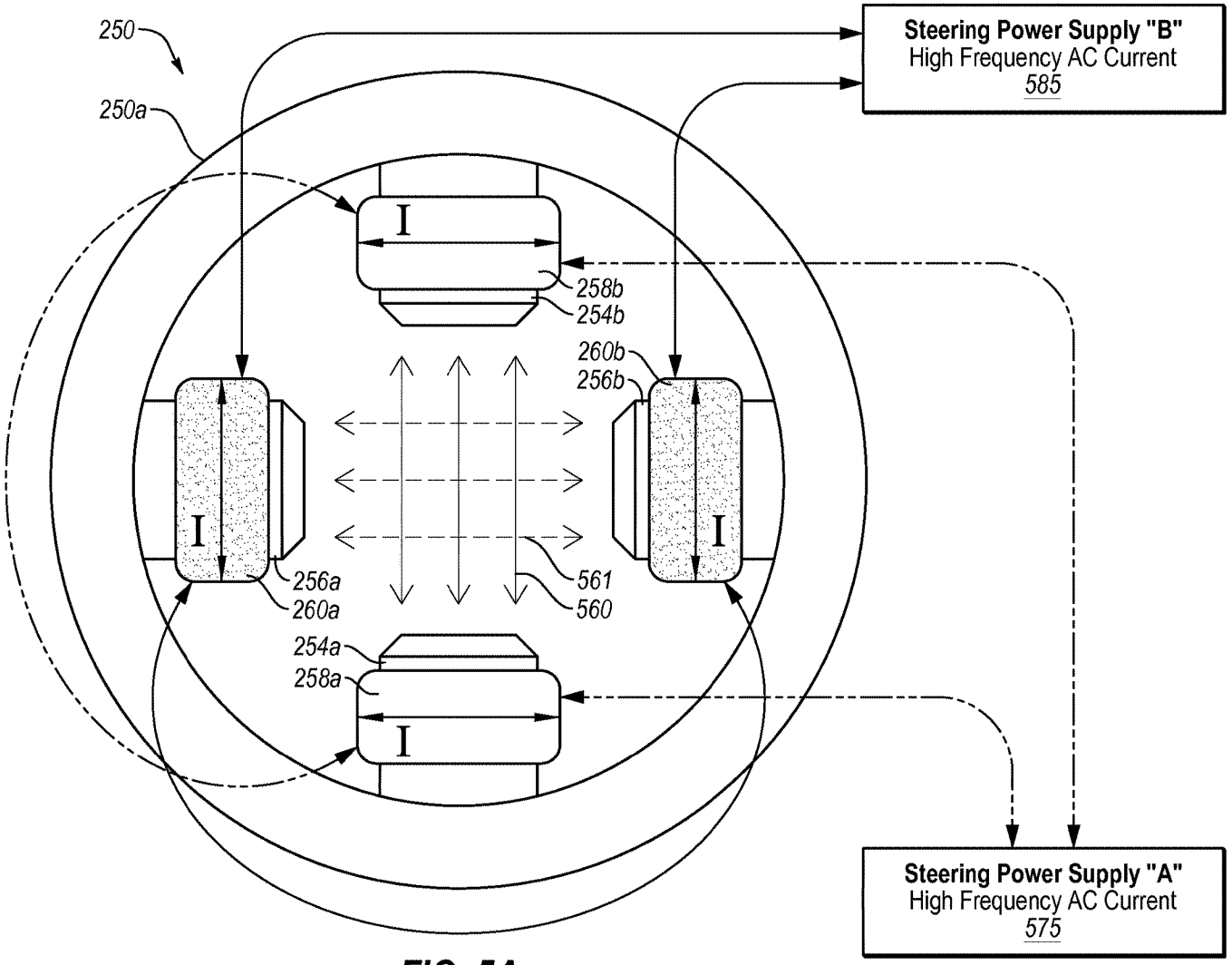
FIG. 5A is a top view of one embodiment of a dipole magnet system.
Figure 5B:
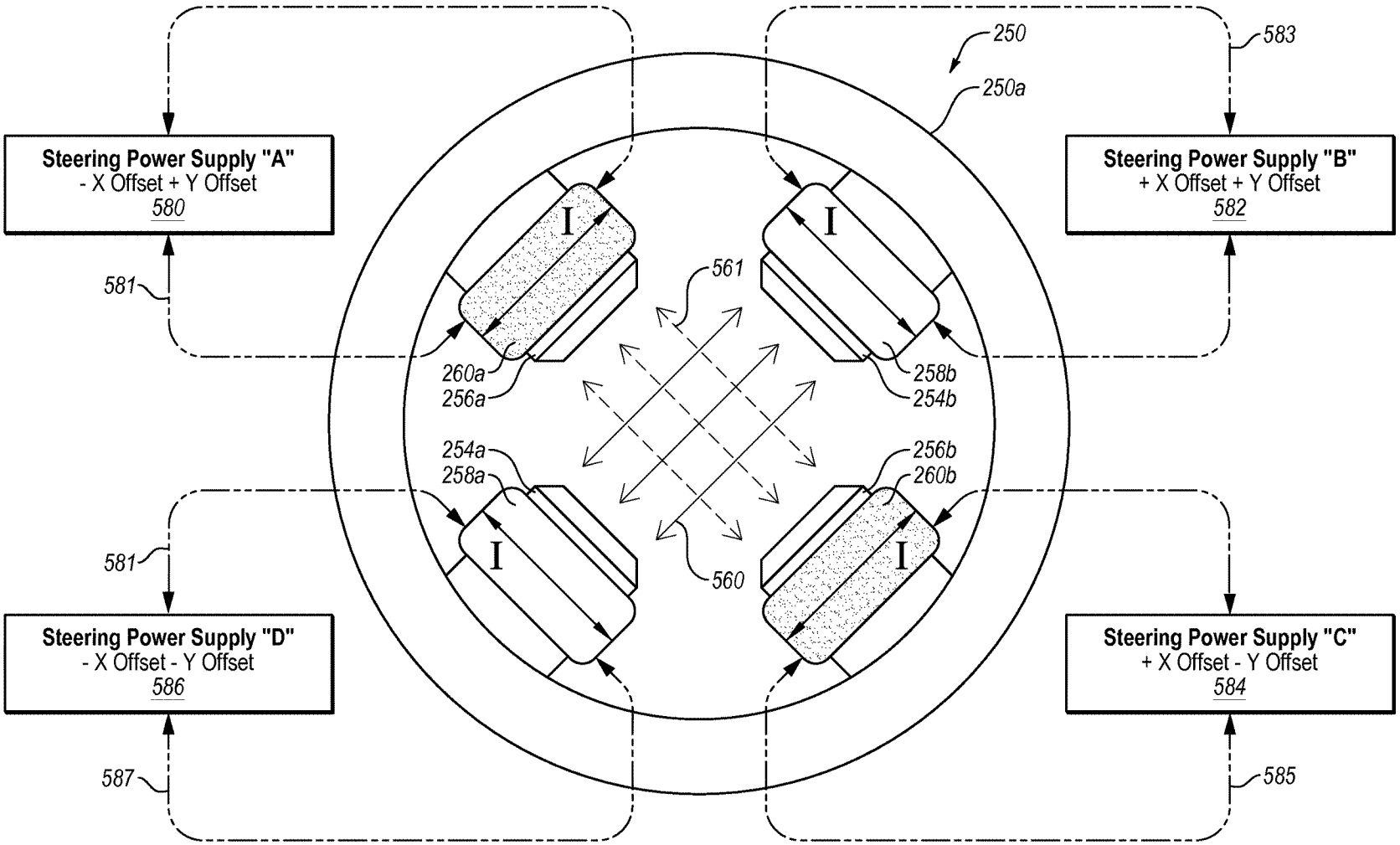
FIG. 5B is a top view of another embodiment of a dipole magnet system.

In one embodiment, the dipole core coils are being controlled independently by the method shown in FIG. 5B, thereby the dipole pole protrusions are in line with the quadrupole pole protrusions at 45, 135, 225 and 315 degrees.

In one embodiment, the pole faces have a reduced profile, such as from ¼ to ⅜ inches across. This can include the pole faces of any of the pole projections, such as for the quadrupole or dipole cores.

In one embodiment, the dipole core can have electromagnets on the pole protrusions that each have their own supply line for power and operation, which can be independently controlled. The 45 degree offset allows for two separate supply systems, one for the two quadrupole cores and one for the dipole core. This allows for an easier implementation of the electronics for the dipole core.

In one embodiment, the X-ray can be configured with a dipole pair in the x and z plane and a dipole pair in the x and y plane, which can provide for a reference axis going in and out of the page. The dipole pairs are configured to move the beam in the x direction, the control can energize a first dipole pair. If there is a desire to move the beam in the z direction, the control can energize the second dipole pair.

In one embodiment, operation of the X-ray tube can allow for steering at about 6 or 7 kHz and the gentry of the X-ray machine rotates at about 4 Hz, which allows for data collection at six spots for a selected position. This allows for six focal spot positions to be recorded in the time previously one focal spot position was available.

In one embodiment, the cores each can include fluidic pathways fluidly coupled to a coolant system, which allows coolant to flow through the yokes, and optionally through the pole projections. As such, each pole projection can have a fluid inlet pathway and a fluid outlet pathway coupled to a fluid pathway in the yoke.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and is not meant to limit the embodiments described herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum enclosure structure 102 may include a cathode housing 104 and an anode housing 106. The cathode housing 104 may be secured to the anode housing 106 such that an interior cathode volume 103 is defined by the cathode housing 104 and an interior anode volume 105 is defined by the anode housing 106, each of which are joined so as to define the vacuum enclosure 102.

In some embodiments, the vacuum enclosure 102 is disposed within an outer housing (not shown) within which a coolant, such as liquid or air, is circulated so as to dissipate heat from the external surfaces of the vacuum enclosure 102. An external heat exchanger (not shown) is operatively connected so as to remove heat from the coolant and recirculate it within the outer housing.

The X-ray tube 100 depicted in FIGS. 1A-1C includes a shield component (sometimes referred to as an electron shield, aperture, or electron collector) 107 that is positioned between the anode housing 106 and the cathode housing 104 so as to further define the vacuum enclosure 102. The cathode housing 104 and the anode housing 106 may each be welded, brazed, or otherwise mechanically coupled to the shield 107. While other configurations can be used, examples of suitable shield implementations are further described in U.S. patent application Ser. No. 13/328,861 filed Dec. 16, 2011 and entitled "X-ray Tube Aperture Having Expansion Joints," and U.S. Pat. No. 7,289,603 entitled "Shield Structure And Focal Spot Control Assembly For X-ray Device," the contents of each of which are incorporated herein by reference for all purposes.

The X-ray tube 100 may also include an X-ray transmissive window 108. Some of the X-rays that are generated in the X-ray tube 100 may exit through the window 108. The window 108 may be composed of beryllium or another suitable X-ray transmissive material.

With specific reference to FIG. 1C, the cathode housing 104 forms a portion of the X-ray tube referred to as a cathode assembly 110. The cathode assembly 110 generally includes components that relate to the generation of electrons that together form an electron beam, denoted at 112. The cathode assembly 110 may also include the components of the X-ray tube between an end 116 of the cathode housing 104 and an anode 114. For example, the cathode assembly 110 may include a cathode head 115 having an electron emitter, generally denoted at 122, disposed at an end of the cathode head 115. As will be further described, in disclosed embodiments the electron emitter 122 is configured as a planar electron emitter. When an electrical current is applied to the electron emitter 122, the electron emitter 122 is configured to emit electrons via thermionic emission, that together form a laminar electron beam 112 that accelerates towards the anode target 128.

The cathode assembly 110 may additionally include an acceleration region 126 further defined by the cathode housing 104 and adjacent to the electron emitter 122. The electrons emitted by the electron emitter 122 form an electron beam 112 and enter and traverse through the acceleration region 126 and accelerate towards the anode 114 due to a suitable voltage differential. More specifically, according to the arbitrarily-defined coordinate system included in FIGS. 1A-1C, the electron beam 112 may accelerate in a z-direction, away from the electron emitter 122 in a direction through the acceleration region 126.

The cathode assembly 110 may additionally include at least part of a drift region 124 defined by a neck portion **124*a* of the cathode housing 104. In this and other embodiments, the drift region 124 may also be in communication with an aperture 150 provided by the shield 107, thereby allowing the electron beam 112 emitted by the electron emitter 122 to propagate through the acceleration region 126, the drift region 124 and aperture 150 until striking the anode target surface 128. In the drift region 124, a rate of acceleration of the electron beam 112 may be reduced from the rate of acceleration in the acceleration region 126. As used herein, the term "drift" describes the propagation of the electrons in the form of the electron beam 112 through the drift region 124**.

Positioned within the anode interior volume 105 defined by the anode housing 106 is the anode 114. The anode 114 is spaced apart from and opposite to the cathode assembly 110 at a terminal end of the drift region 124. Generally, the anode 114 may be at least partially composed of a thermally conductive material or substrate, denoted at 160. For example, the conductive material may include tungsten or molybdenum alloy. The backside of the anode substrate 160 may include additional thermally conductive material, such as a graphite backing, denoted by way of example here at 162.

The anode 114 may be configured to rotate via a rotatably mounted shaft, denoted here as 164, which rotates via an inductively induced rotational force on a rotor assembly via ball bearings, liquid metal bearings or other suitable structure. As the electron beam 112 is emitted from the electron emitter 122, electrons impinge upon a target surface 128 of the anode 114. The target surface 128 is shaped as a ring around the rotating anode 114. The location in which the electron beam 112 impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the impinging electrons to generate X-rays in a manner that is well known.

During operation of the X-ray tube 100, the anode 114 and the electron emitter 122 are connected in an electrical circuit. The electrical circuit allows the application of a high voltage potential between the anode 114 and the electron emitter 122. Additionally, the electron emitter 122 is connected to a power source such that an electrical current is passed through the electron emitter 122 to cause electrons to be generated by thermionic emission. The application of a high voltage differential between the anode 114 and the electron emitter 122 causes the emitted electrons to form an electron beam 112 that accelerates through the acceleration region 126 and the drift region 124 towards the target surface 128. Specifically, the high voltage differential causes the electron beam 112 to accelerate through the acceleration region 126 and then drift through the drift region 124. As the electrons within the electron beam 112 accelerate, the electron beam 112 gains kinetic energy. Upon striking the target surface 128, some of this kinetic energy is converted into electromagnetic radiation having a high frequency, i.e., X-rays. The target surface 128 is oriented with respect to the window 108 such that the X-rays are directed towards the window 108. At least some portion of the X-rays then exit the X-ray tube 100 via the window 108.

FIG. 1C shows a cross-sectional view of an embodiment of a cathode assembly 110 that can be used in the X-ray tube 100 with the planar electron emitter 122 and magnetic system 200 described herein. As illustrated, a throw path between the electron emitter 122 and target surface 128 of the anode 114 can include the acceleration region 126, drift region 124, and aperture 150 formed in shield 107. In the illustrated embodiment, the aperture 150 is formed via aperture neck 154 and an expanded electron collection surface 156 that is oriented towards the anode 114.

Optionally, one or more electron beam manipulation components can be provided. Such devices can be implemented so as to "focus," "steer" and/or "deflect" the electron beam 112 as it traverses the region 124, thereby manipulating or "toggling" the position and/or dimension of the focal spot on the target surface 128. Additionally or alternatively, a manipulation component can be used to alter or "focus" the cross-sectional shape (e.g., length and width) of the electron beam and thereby change the shape and dimension of the focal spot on the target surface 128. In the illustrated embodiments electron beam focusing and steering are provided by way of a magnetic system denoted generally at 200.

Figure 2A:
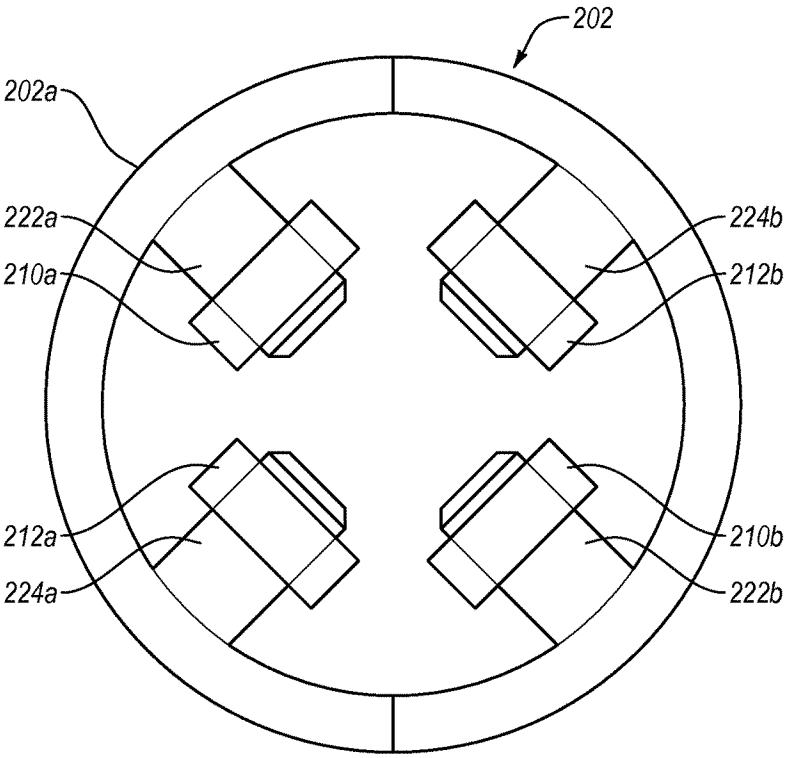
FIG. 2A is a top view of an embodiment of an anode quadrupole core.
Figure 2B:
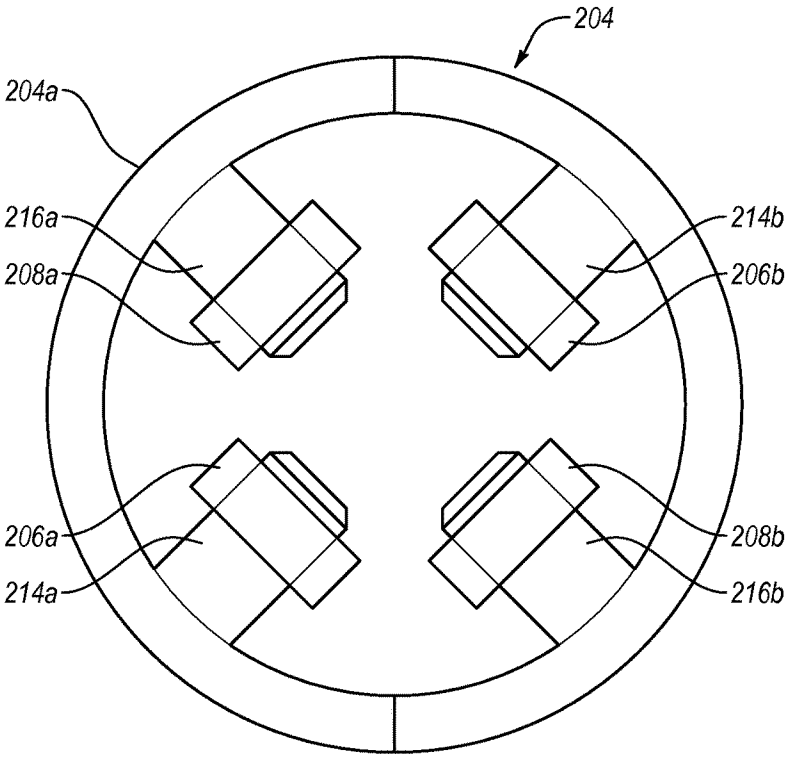
FIG. 2B is a top view of an embodiment of a cathode quadrupole core.

The magnetic system 200 can include various combinations of quadrupole and dipole implementations that are disposed so as to impose magnetic forces on the electron beam so as to steer and/or focus the beam. One example of the magnetic system 200 and components thereof is shown in FIGS. 1A-1C, and 2A-2D. In this embodiment, the magnetic system 200 is implemented as two magnetic quadrupole cores 202, 204 and one magnetic dipole core 250 disposed in the electron beam path 112 of the X-ray tube 100. The two quadrupole cores 202, 204 are configured to (a) focus in both directions perpendicular to the beam path, and optionally (b) to steer the beam in both directions perpendicular to the beam path. In this way, the two quadrupole cores 202, 204 act together to form a magnetic lens (sometimes referred to as a "doublet"), and the focusing and steering is accomplished as the electron beam passes through the quadrupole "lens." The "focusing" provides a desired focal spot shape and size, and the "steering" effects the positioning of the focal spot on the anode target surface 128. Each quadrupole core 202, 204 is implemented with a core section, or a yoke, denoted as a cathode quadrupole yoke at 204*a*, and an anode quadrupole yoke at 202*a*. FIG. 2A shows an embodiment of an anode quadrupole core 202 having an anode quadrupole yoke 202*a*, and FIG. 2B shows an embodiment of a cathode quadrupole core 204 having a cathode quadrupole yoke 204*a*. Each quadrupole yoke 202*a*, 204*a* includes four pole projections arranged in an opposing relationship, cathode projections 214*a,b* (e.g., first cathode projections) and 216*a,b* (e.g., second cathode projections) on the cathode yoke 204*a*, and anode projections 222*a,b* (e.g., first anode projections) and 224*a,b* (e.g., second anode projections) on the anode yoke 202*a*. Each quadrupole pole projection includes corresponding coils, denoted at cathode coils 206*a,b* (e.g., first cathode coils) and 208*a,b* (e.g., second cathode coils) on the cathode yoke 204*a* and anode coils 210*a,b* (e.g., first anode coils) and 212*a,b* (e.g., second anode coils) on the anode yoke 202*a*. Current is supplied to the coils so as to provide the desired focusing and/or steering effect, as will be described in further detail below.

Figure 2C:
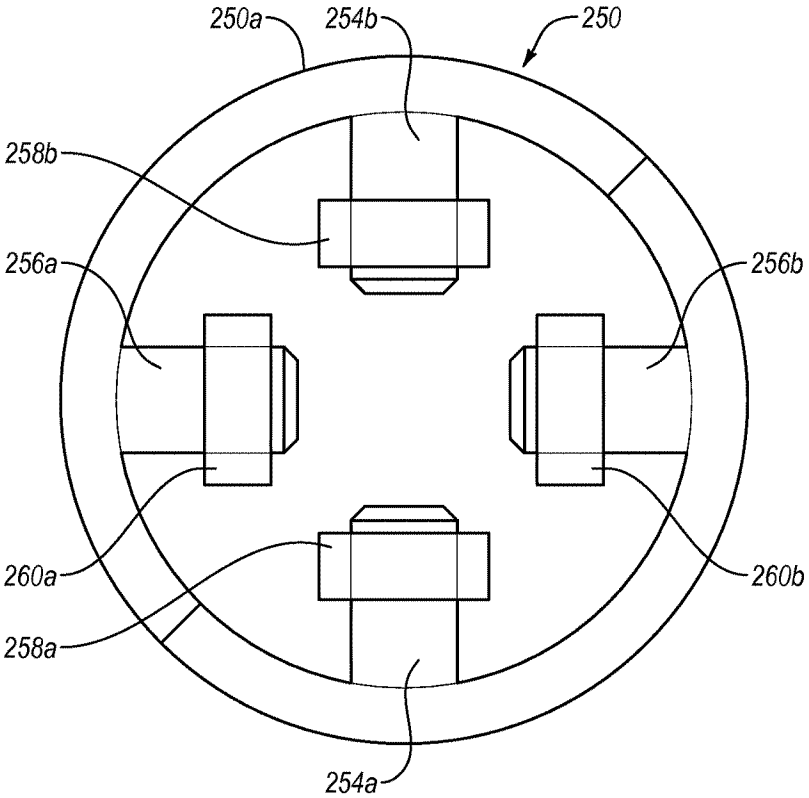
FIG. 2C is a top view of an embodiment of a dipole core.

The dipole core 250 as shown in FIG. 2C is implemented with a core section or yoke, denoted at dipole yoke 250*a*. The dipole yoke 250*a* includes four pole projections arranged in opposing relationships, dipole projections 254*a,b* (e.g., first dipole projections) and 256*a,b* (e.g., second dipole projections). Each dipole projection includes corresponding coils, denoted at dipole coils 258*a,b* (e.g., first dipole coils) 260*a,b* (e.g., second dipole coils). Current is supplied to the coils so as to provide the desired steering effect, as will be described in further detail below.

Figure 2D:
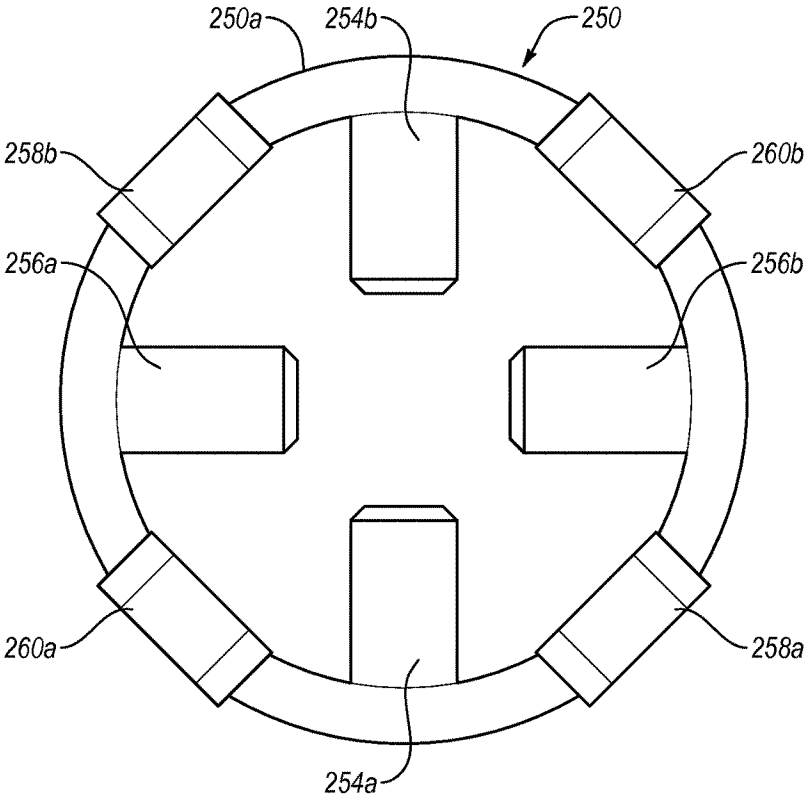
FIG. 2D is a top view of another embodiment of a dipole core.

The dipole core 250 as shown in FIG. 2D is implemented with a core section or yoke, denoted at dipole yoke 250*a*. The dipole yoke 250*a* includes four pole projections arranged in opposing relationships, dipole projections 254*a,b* (e.g., first dipole projections) and 256*a, b* (e.g., second dipole projections). Between the dipole projections are corresponding coils, denoted at dipole coils 258*a,b* (e.g., first dipole coils) 260*a,b* (e.g., second dipole coils). Current is supplied to the coils so as to provide the desired steering effect, as will be described in further detail below. Here, the coils are not on the protrusions, but between the protrusions.

Figure 3:
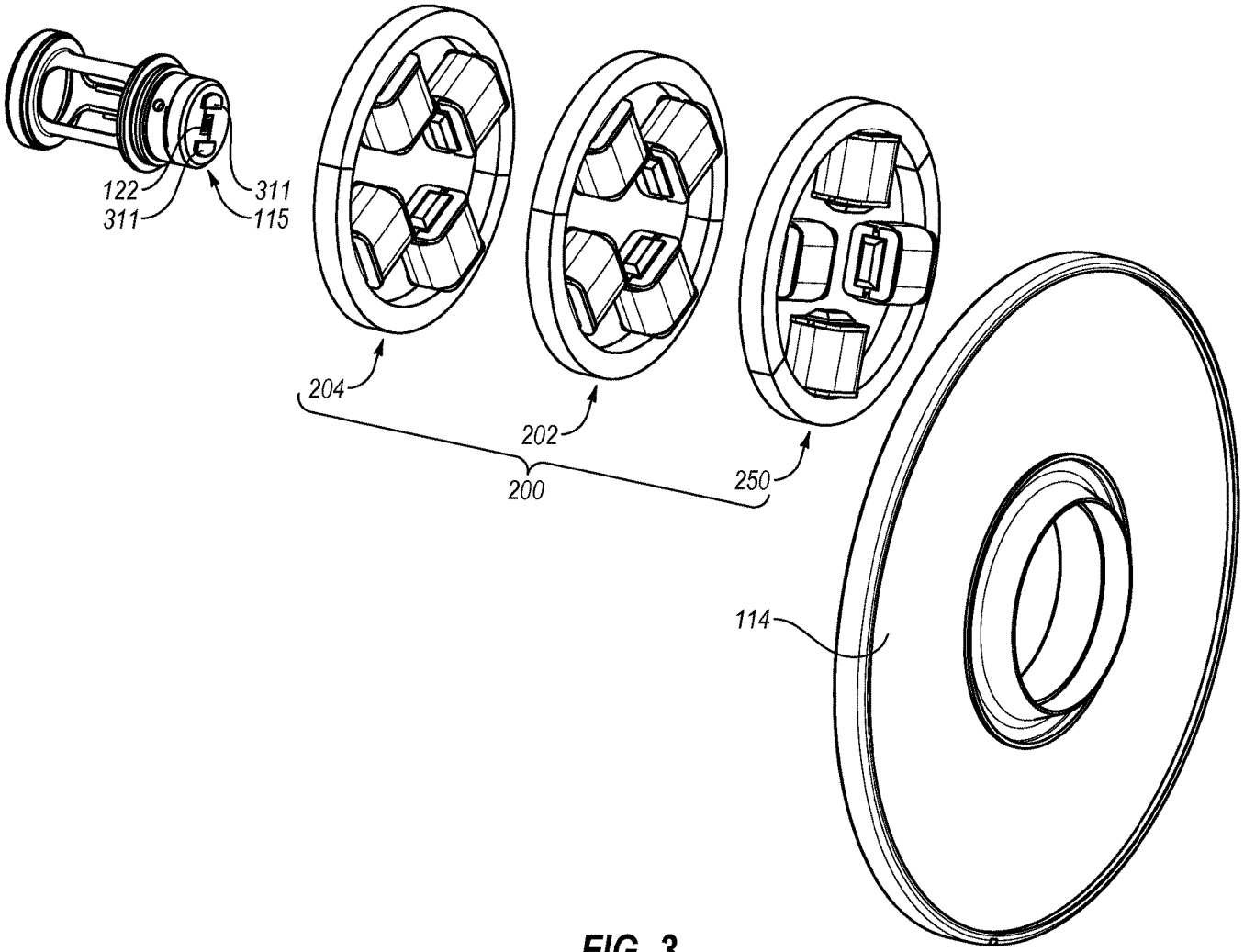
FIG. 3 is a perspective view of internal components of an embodiment of an example X-ray tube.

FIG. 3 shows the components of the X-ray device that are arranged for electron emission, electron beam steering or focusing, and X-ray emission. The cathode head 115 is shown with the planar electron emitter 122 oriented so as to emit electrons in a beam 112 towards the anode 114. In FIG. 3, disposed within the beam path is the magnetic system 200 configured to focus and steer the electron beam before reaching the anode 114, as noted above. A portion of the cathode assembly 110 has the cathode head 115 with the electron emitter 122 on an end of the cathode head 115 so as to be oriented or pointed toward the anode 114 (see FIGS. 1C and 3 for orientation). The cathode head 115 can include a head surface 319 that has an emitter region that is formed as a recess that is configured to receive the electron emitter 122, The head surface also includes electron beam focusing elements 311 located on opposite sides of the electron emitter 122.

In one embodiment, the electron emitter 122 can be comprised of a tungsten foil, although other materials can be used. Alloys of tungsten and other tungsten variants can be used. Also, the emitting surface can be coated with a composition that reduces the emission temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

As noted above, certain embodiments include an electron beam manipulation system that allows for steering and/or focusing of the electron beam so as to control the position and/or size and shape of the focal spot on the anode target. In one embodiment, this manipulation is provided by way of a magnetic system implemented as two magnetic quadrupole cores and one magnetic dipole core disposed in the electron beam path. For example, in one embodiment, two quadrupole cores are used to provide focusing of the electron beam and the dipole core can also be used for steering. In this approach, focusing magnetic fields would be provided by both quadrupole cores (the anode side quadrupole core and the cathode side quadrupole core) and the electron beam steering magnetic fields would be provided by one of the quadrupole cores (e.g., the anode side quadrupole core) or only by the dipole core. Alternatively, magnetic fields for steering could be done for one direction with one quadrupole and for the other direction with the other quadrupole, or using the dipole for assistance in steering or for performing all steering. In this way, combined beam focusing can be provided using only quadrupoles. In another alternative, the dipole can be used only for steering.

Figure 4A:
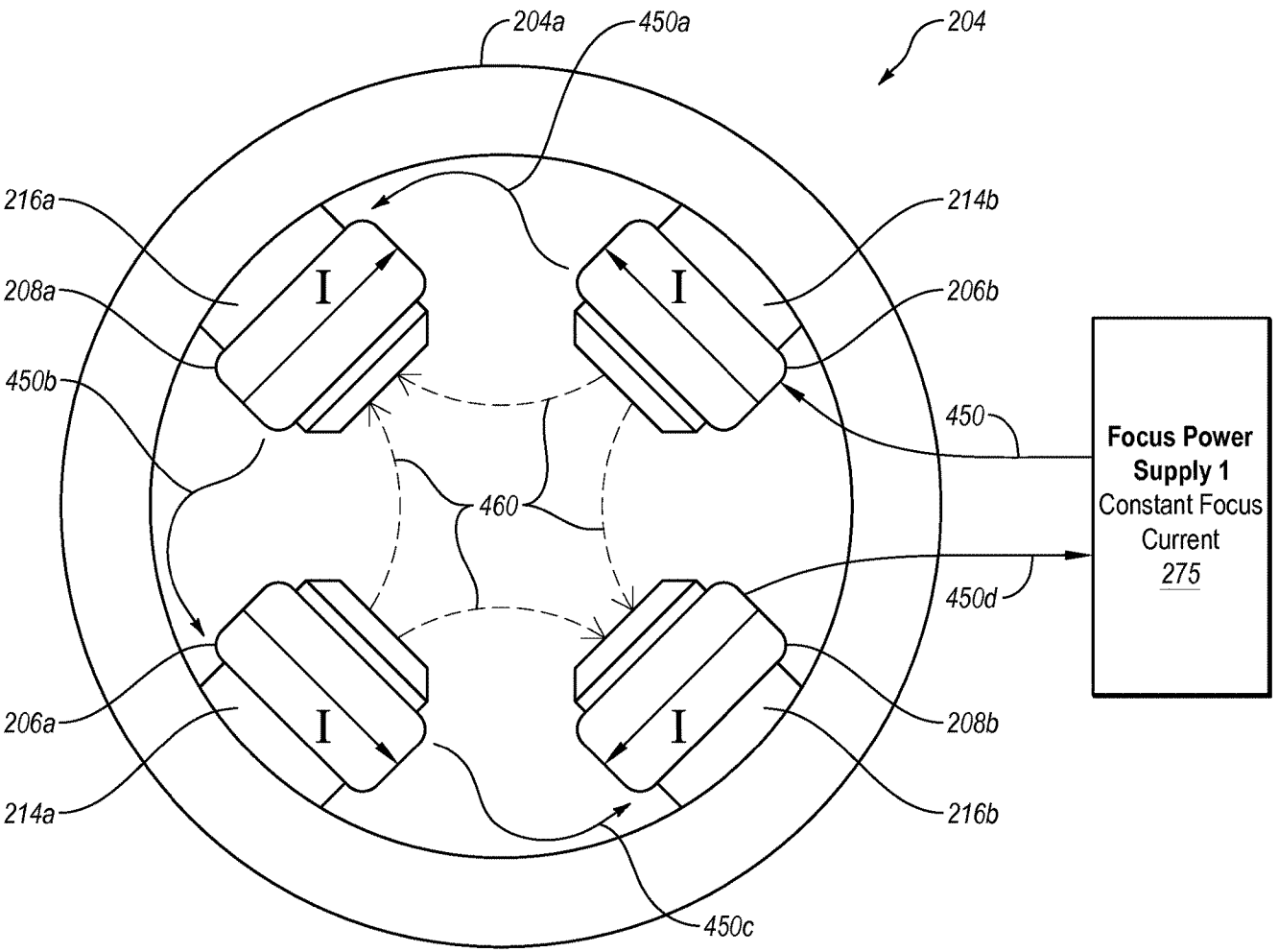
FIG. 4A is a top view of one embodiment of a cathode quadrupole magnet system.
Figure 4B:
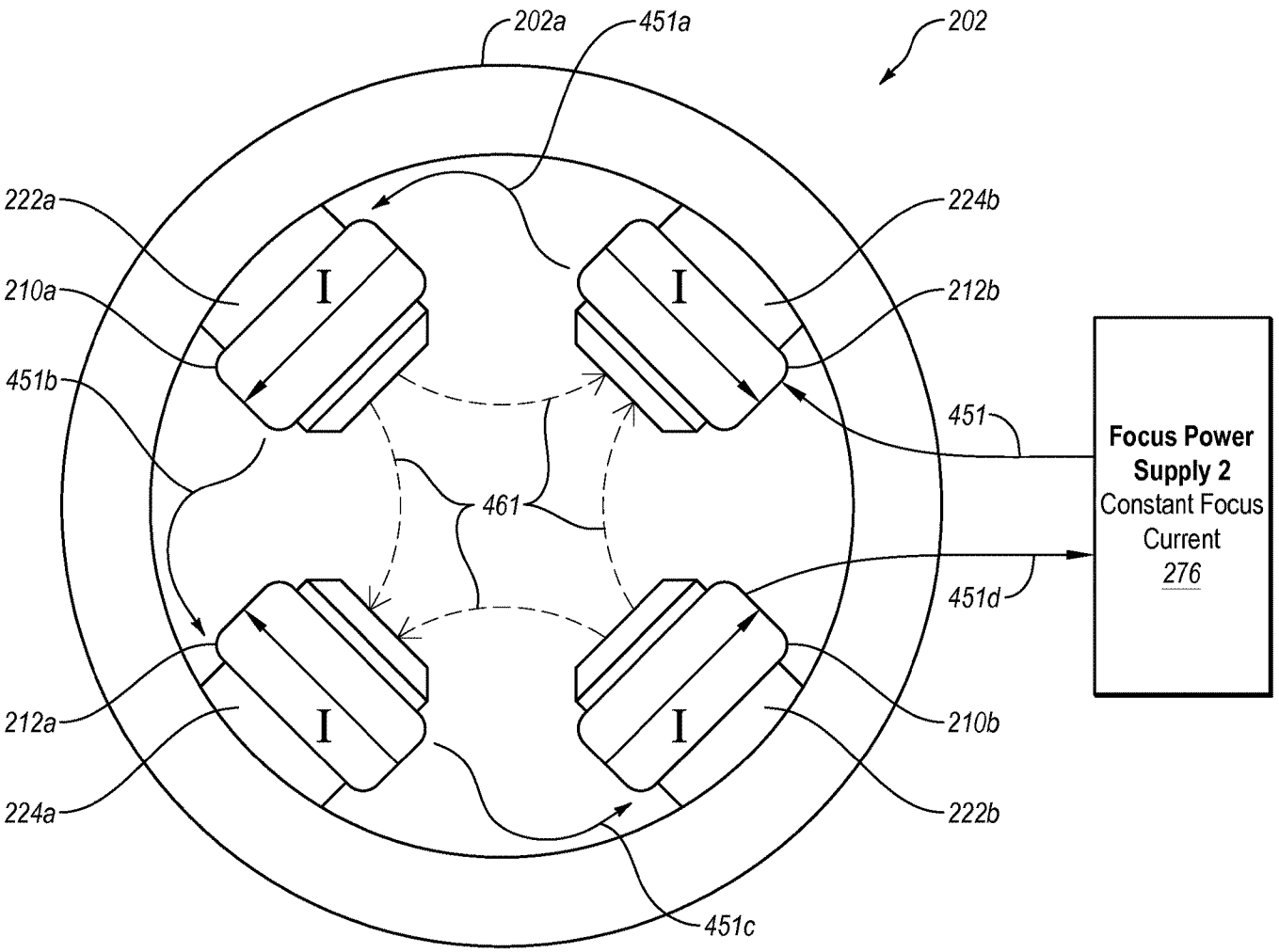
FIG. 4B is a top view of one embodiment of an anode quadrupole magnet system.

In this context, in conjunction with the embodiments shown in FIGS. 1A-1C and 2A-2D (with reference to the magnetic system 200 in particular), reference is further made to FIGS. 4A and 4B. FIG. 4A shows an embodiment of a cathode core 204 having a cathode yoke 204*a* configured as a quadrupole (e.g., cathode-side magnetic quadrupole 204), and FIG. 4B illustrates an embodiment of an anode core 202 having an anode yoke 202*a*, also configured as a quadrupole (e.g., anode-side magnetic quadrupole 202). As previously described, in this example each core section includes a yoke having four pole projections arranged in an opposing relationship, 214*a,b* and 216*a,b* on the cathode yoke 204*a*, and 222*a,b* and 224*a,b* on the anode yoke 202*a*. Each pole projection includes corresponding coils, denoted at 206*a,b* and 208*a,b* on the cathode core 204 and 212*a,b* and 210*a,b* on the anode core 202. While illustrated as having a substantially circular shape, it will be appreciated that each of the core (or yoke) portions 202*a*, 204*a* can also be configured with different shapes, such as a square orientation, semi-circular, oval, or other.

The two magnetic quadrupole cores 202, 204 act as lenses, and may be arranged so that the corresponding electromagnets thereof are in parallel with respect to each other, and perpendicular to the optical axis defined by the electron beam 112. The quadrupole cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have a symmetry with respect to the optical axis or with respect to a plane through the optical axis.

With continued reference to the figures, the double magnetic quadrupole includes an anode-side magnetic quadrupole core, generally designated at 202 and a second cathode-side magnetic quadrupole core, generally designated at 204, that are together positioned approximately between the cathode and the target anode and disposed around the neck portion 124*a* as previously described. The anode side quadrupole core 202 in one option can be further configured to provide a dipole field effect that enables a shifting of the focal spot in a plane perpendicular to an optical axis correspondent to electron beam 112 of the X-ray device. In an example embodiment, the cathode-side magnetic quadrupole core 204 focuses in a length direction, and defocuses in width direction of the focal spot. The electron beam is then focused in width direction and defocused in length direction by the following anode-side magnetic quadrupole core 202. In combination the two sequentially arranged magnetic quadrupoles insure a net focusing effect in both directions of the focal spot.

With continued reference to FIG. 4A, a top view of a cathode-side magnetic quadrupole core 204 is shown. A circular core or yoke portion, denoted at 204*a* is provided, which includes four pole projections 214*a*, 214*b*, 216*a*, 216*b* that are directed toward the center of the circular yoke 204*a*. On each of the pole projections is provided a coil, as shown at 206*a*, 206*b*, 208*a* and 208*b*. In an example implementation, the yoke 204*a* and the pole projections 214*a*, 214*b*, 216*a*, 216*b* are constructed of core iron. Moreover each coil is comprised of 22 gauge magnet wire at 60 turns; obviously other configurations would be suitable depending on the needs of a particular application.

As is further shown in FIG. 4A, the illustrated example includes a Focus Power Supply 275 for providing a predetermined current to the four coils, which are connected in electrical series, as denoted schematically at 450, 450*a*, 450*b* 450*c*, and 450*d*. In this embodiment, the current supplied is substantially constant, and results in a current flow within each coil as denoted by the letter 'I' and corresponding arrow, in turn resulting in a magnetic field schematically denoted at 460. The magnitude of the current is selected so as to provide a desired magnetic field that result in a desired focusing effect.

Reference is next made to FIG. 4B, which illustrates an example of a top view of an anode-side magnetic quadrupole core 202. As with quadrupole core 204, a circular core or yoke portion, denoted at 202*a* is provided, which includes four pole projections 222*a*, 222*b*, 224*a*, 224*b* also directed toward the center of the circular yoke 202*a*. On each of the pole projections is provided a coil, as shown at 210*a*, 210*b*, 212*a* and 212*b*. In conjunction with quadrupole core 204, the yoke 202*a* and projections on quadrupole core 202 is comprised of the same material as for the cathode quadrupole core 204, which can be core iron. However, the anode quadrupole core 202 can be prepared from a low loss ferrite material so as to better respond to steering frequencies (described below). The coils can utilize similar gauge magnet wire and similar turns ratio, with variations depending on the needs of a given application.

As is further shown in FIG. 4B, the illustrated example includes a Focus Power Supply 276 for providing a predetermined current to the four coils, which are connected in electrical series, as denoted schematically at 451, 451*a*, 451*b*, 451*c*, and 451*d*. In this embodiment, the current supplied is substantially constant, and results in a current flow within each coil as denoted by the letter 'I' and corresponding arrow, in turn resulting in a magnetic field schematically denoted at 461. The magnitude of the current is selected so as to provide a desired magnetic field that result in a desired focusing effect.

FIG. 5A shows an embodiment of a dipole core 250 having a dipole yoke 250*a*. Dipole coils 258*a,b* (e.g., first dipole coils) and 260*a,b* (e.g., second dipole coils) are located on each of the pole projections 254*a,b* (e.g., first dipole projections) and 256*a,b* (e.g., second dipole projections). The first dipole coils 258*a,b* are shown to be energized by a first dipole power supply (Steering Power Supply "A"), denoted at 575, and the second dipole coils 260*a,b* are shown to be energized by the second dipole power supply (Steering Power Supply "B"), denoted at 585. The first dipole coils 258*a,b* cooperate to form the first dipole magnetic field 560, and the second dipole coils 260*a,b* cooperate to form the second dipole magnetic field 561.

Another example of the dipole core 250 is shown in FIG. 5B, where each of the dipole coils 258*a*, 258*b*, 260*a* and 260*b* is connected to a separate and independent power source for providing current to induce a magnetic field in the respective coil. The power supplies are denoted at 580 (Steering Power Supply A), 582 (Steering Power Supply B), 584 (Steering Power Supply C) and 586 (Steering Power Supply D) and are electrically connected as denoted by the schematic electrical circuit associated with each supply (e.g., 581, 583, 585, 587). The dipole core coils can be controlled independently by the method shown in FIG. 5B, thereby the dipole pole protrusions are in line with the quadrupole pole protrusions at 45, 135, 225 and 315 degrees.

The configurations of FIGS. 5A and 5B provide for dipole steering. The dipole pairs (e.g., 258*a,b* are a first dipole pair and 260*a,b* are a second dipole pair) are configured to provide a dipole magnetic effect, and the requisite dipole effect is provided by supplying each of the dipole coils is provided with an X offset current and a Y offset current. The duration of the offset currents are at a predetermined frequency and the respective offset current magnitudes are designed to achieve a desired dipole field and, in turn, a resultant shift in the electron beam (and focal spot). Thus, each coil is driven independently (FIG. 5B) or each dipole coil pair is driven independently (FIG. 5A) with an appropriate current at the desired focal spot steering frequency by application of desired X offset and Y offset currents in corresponding dipole pairs. This effectively moves the center of the magnetic field in the 'x' or 'y' direction. The dipoles provide a lateral force on the electrons as they pass through the region between the pole faces. This force perturbates the beam and during the drift time, the electrons travel their perturbated path and end up at a desired focal spot. Due to the minimal mass of an electron, they follow the changes in this magnetic field practically instantaneously. Hence, operation of the X-ray tube can achieve fast switching as the magnetic field acts on successive electrons in the stream.

Figure 6A:
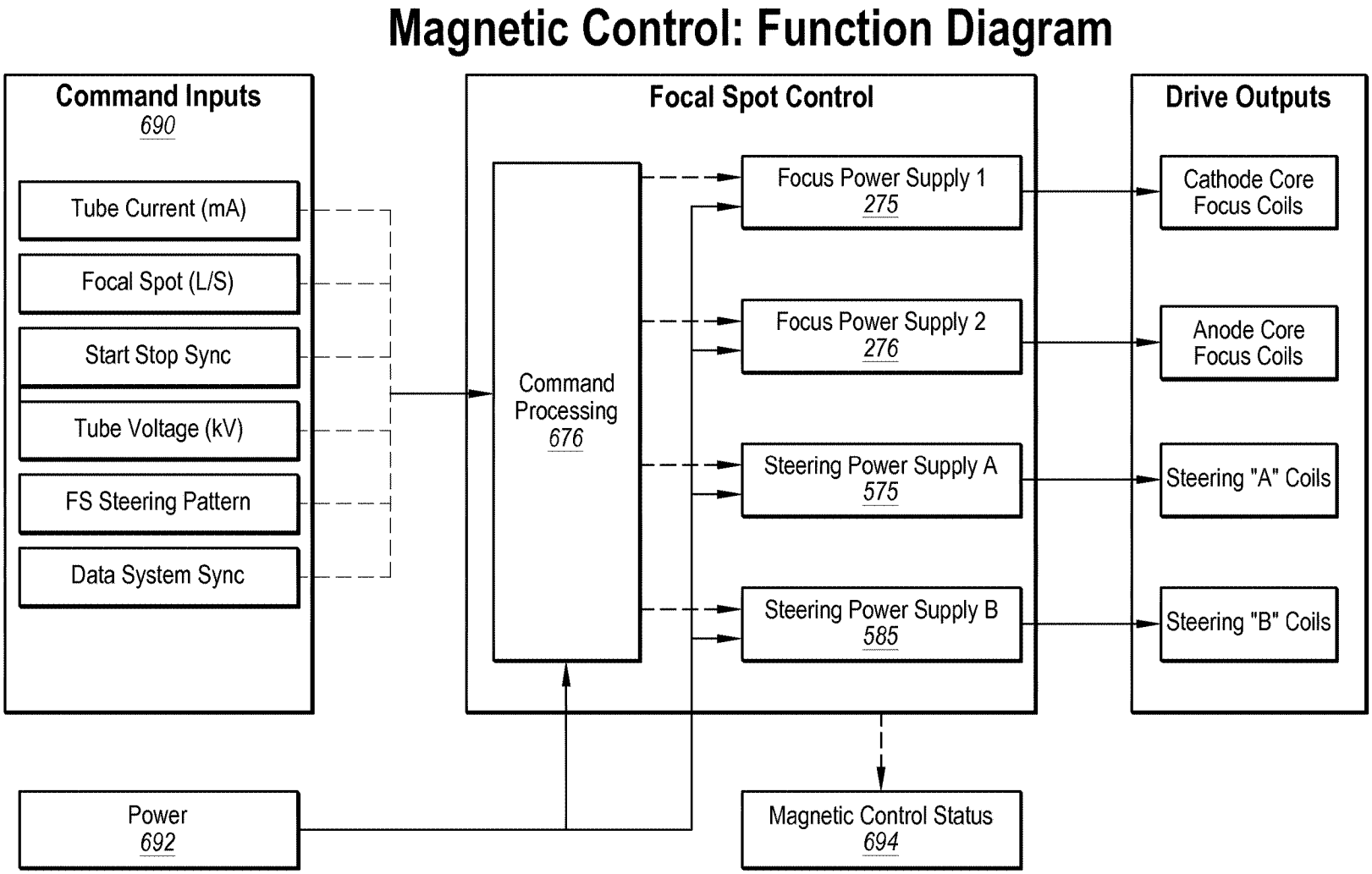
FIGS. 6A-6B are functional block diagrams, each showing one embodiment of a magnetic control.
Figure 6B:
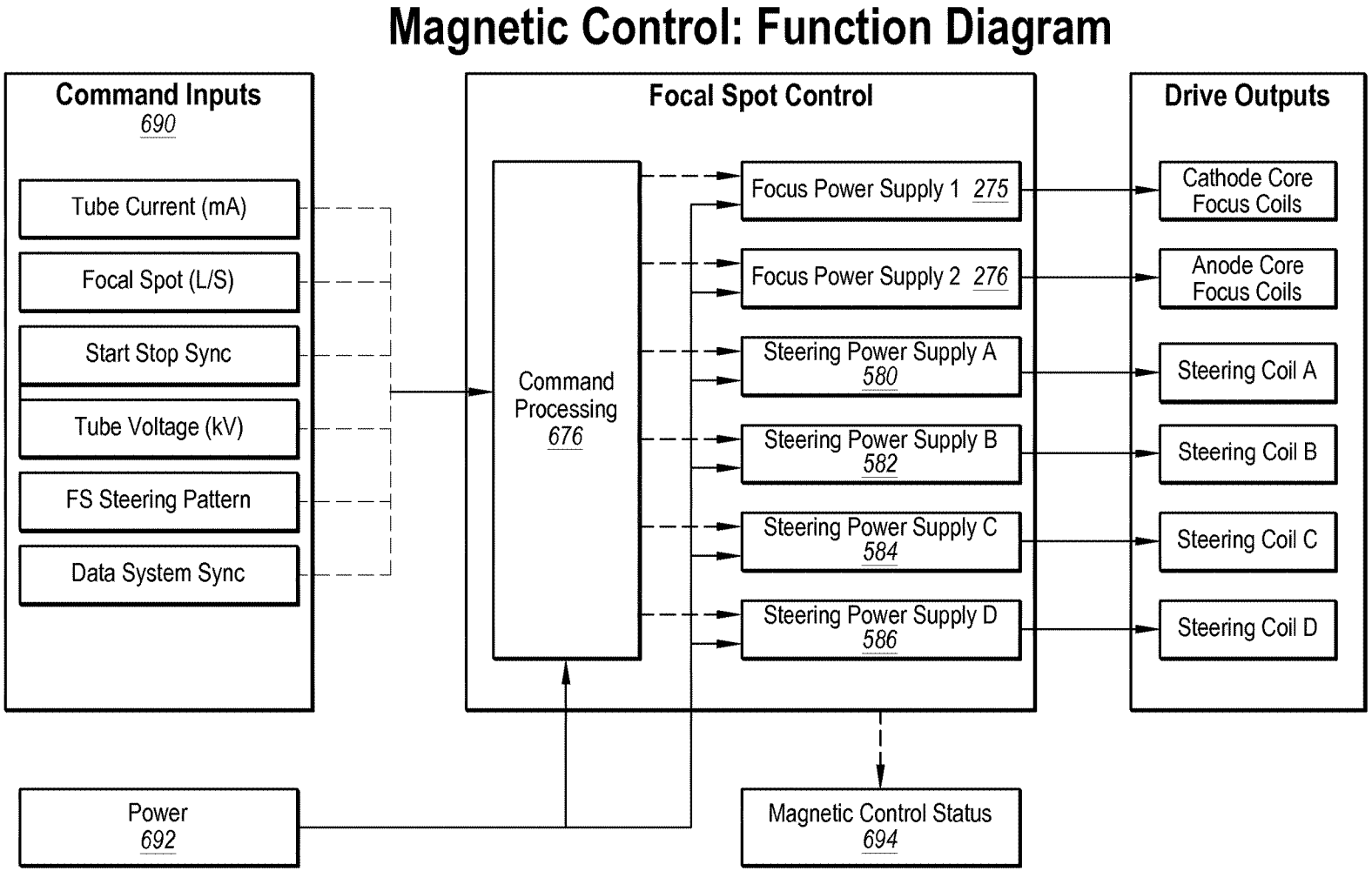

Reference is next made to FIG. 6A-6B, which illustrate functional diagrams illustrating an embodiment of a magnetic control system for controlling the operation of the quadrupole systems of FIGS. 4A-4B and dipoles of FIGS. 5A-5B. At a high level, the magnetic control systems of FIG. 6A-6B provide the requisite control of coil currents supplied to the quadrupole pair 202 and 204 and/or dipole 250 so as to (1) provide a requisite quadrupole field so as to achieve a desired focus of the focal spot; and (2) provide a requisite dipole field so as to achieve a desired position of the focal spot. As noted, control of the dipole coil currents is accomplished in a manner so as to achieve a desired steering frequency.

The embodiment of FIG. 6A includes a command processing device 676, which may be implemented with any appropriate programmable device, such as a microprocessor or microcontroller, or equivalent electronics. The command processing device 676 controls, for example, the operation of each of the independent power supplies of FIGS. 4A-4B and 5A (i.e., which provide corresponding coils operating current to create a magnetic field), preferably in accordance with parameters stored in non-volatile memory, such as that denoted at Command Inputs 690. For example, in an example operational scheme, parameters stored/defined in Command Inputs 690 might include one or more of the following parameters relevant to the focusing and/or steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot; and Data System Sync (to sync an X-ray beam pattern with a corresponding imaging system).

In an exemplary implementation for the quadrupoles of FIGS. 4A and 4B and dipole of FIG. 5A is shown in FIG. 6A, the command inputs 690 can be provided to command processing 676, which then communicates with the Focus Power Supply 1 (275) and Focus Power supply 2 (276) for the quadrupoles and Steering Power Supply A 575 and Steering Power Supply B 585 for the dipoles, which then provide drive outputs for the cathode core focus coils and anode core focus coils as well as the dipole steering coils.

Thus, by way of one example, a Focal Spot size specified as 'small' would cause the Command Processing unit 676 to control the Focus Power Supply 275 to provide a constant focus current having the prescribed magnitude (corresponding to a 'small' focal spot) to each of the coils (206*b*, 208*a*, 206*a*, 208*b*) of the cathode-side magnetic quadrupole 204, as described above. Similarly, the Power Supply 276 would also be controlled to provide a constant focus (DC) current, having the same magnitude as supplied by 275, to each of the coils of the anode-side magnetic quadrupole 202. Again, this would result in a quadrupole magnetic field that imposes focusing forces on the electron beam so as to result in a 'small' focal spot on the anode target.

Also, a FS Steering Pattern might prescribe a specific focal spot steering frequency and requisite displacement in an 'x' or 'y' direction. This would result in Command Processing unit 676 to control each of the Steering Power Supply A 575 and Steering Power Supply B 585 to supply a requisite X-offset and Y offset AC current magnitudes to the corresponding coils of the dipole 250, thereby creating a desired dipole steering effect, in addition to the beam (focal spot) focus, as described above.

In an example embodiment, each of the Power Supplies 275, 276, 575, and 585 are high-speed switching supplies, and which receive electrical power from a main power supply denoted at 692. Magnetic Control Status 694 receives status information pertaining to the operation of the power supplies and the coils, and may be monitored by command processing unit 676 and/or an external monitor control apparatus (not shown).

Thus, in the embodiments of FIGS. 4A-4B, 5A, and FIG. 6A or 6B, a magnetic system providing electron beam focusing and two-axis beam steering via two quadrupoles and a dipole is provided. While an example embodiment is shown, it will be appreciated that alternate approaches are contemplated. For example, steering of the electron beam is provided by way of a dipole effect of the dipole 250, however, the steering can be provided or supplemented by the coils on the anode-side magnetic quadrupole 202. It will be appreciated that both the anode core 202 and the cathode core 204 implement focusing. Additionally, the dipoles of FIGS. 5A-5B can also be similarly controlled with a common controller or a separate controller.

In yet another example embodiment, a magnetic system implemented as two magnetic quadrupoles and a dipole can be disposed in the electron beam path of an X-ray tube is provided. Similar to the embodiment described above, the two magnetic quadrupoles are configured to focus the electron beam path in both directions perpendicular to the beam path. However, instead of implementing a dipole function via a quadrupole and a dipole as described above, two dipoles are collocated on a dipole core to steer the beam in both directions ('x' and 'y') perpendicular to the beam path. Again, the two quadrupoles form a quadrupole magnetic lens (sometimes referred to as a "doublet") and the focusing is accomplished as the beam passes through the quadrupole lens. The steering is accomplished by the two dipoles of the dipole core 250 which are created by coils wound on one of the dipole core 250 pole projections 254*a,b* and 256*a,b*, while the quadrupole coils maintain the focusing coil current. Steering of the electron beam (and resulting shifting of the focal spot) occurs through appropriate dipole coil pair energizing and can be done in one axis or a combination of axes. In one embodiment, one quadrupole is used to focus in the first direction and the second quadrupole to focus in the second direction and the dipole core with two separate dipoles to steer in both directions.

Reference is next made to FIGS. 4A-4B and 5B, which together illustrate one example. Here, the dipole pairs are configured to provide a dipole magnetic effect, and the requisite dipole effect is provided by supplying each of the dipole coils is provided with an X offset current and a Y offset current. The duration of the offset AC currents are at a predetermined frequency and the respective offset current magnitudes are designed to achieve a desired dipole field and, in turn, a resultant shift in the electron beam (and focal spot). Thus, each coil is driven independently, the quadrupole coils with a constant focus current, and dipole coil pairs with an appropriate current at the desired focal spot steering frequency by application of desired X offset and Y offset currents in corresponding dipole pairs. This effectively moves the center of the magnetic field in the 'x' or 'y' direction, which in turn results in a shifting of the electron beam (and resultant position of the focal spot on the anode target) in a prescribed 'x' or 'y' direction.

Reference is next made to FIG. 6B, which illustrates a functional diagram illustrating an embodiment of a magnetic control system for controlling the operation of the quadrupole and dipole system of FIGS. 4A-4B and 5B. At a high level, the magnetic control system of FIG. 6B provides the requisite control of coil currents supplied to the quadrupole coils and the dipole coils so as to (1) provide a requisite quadrupole field so as to achieve a desired focus of the focal spot; and (2) provide a requisite dipole field so as to achieve a desired position of the focal spot. As noted, control of the coil currents is accomplished in a manner so as to achieve a desired steering frequency.

The functional processing associated with the magnetic control system of FIG. 6B is similar in most respects to that of FIG. 6A except that each of the Focus Power Supplies 1 (275) and 2 (276) provide a requisite focus DC current to the quadrupole coils, and the Steering Power Supplies A (580), B (582), C (584) and D (586) provide an requisite steering AC current and amplitude to the dipole coils to provide a desired dipole magnetic effect so as to achieve a required electron beam shift (focal spot movement).

Thus, in the embodiment of FIGS. 4A-4B, 5B, and 6B, a magnetic system providing electron beam focusing and two-axis beam steering via two quadrupoles and two dipoles (both on the same dipole core) is provided. While an example embodiment is shown, it will be appreciated that alternate approaches are contemplated. For example, while steering of the electron beam is provided by way of a dipole effect provided completely by the two dipoles, it will be appreciated that both the anode core 202 and the cathode core 204 can facilitate focusing. Other variations would also be contemplated.

In one aspect, the magnetic controller can be operated by command inputs. For example, the following inputs (e.g., input by user into controller) can be used to run the magnetic control system: Implemented for focusing: Tube Current (mA), Numeric Input: ex 450; Focal Spot (L/S), Large or Small Focal Spot; Start Stop Sync, to determine when to power on focus and power off; Implemented for focusing and steering: Tube Voltage (kV), Numeric Input: ex 120; Implemented for Steering: FS Steering Pattern, Pattern 1, 2, or 3, etc.; and Implemented for data collection: Data System Sync, to sync beam pattern with imaging system.

In one aspect, the magnetic controller can be operated with command inputs for focal spot control. For example, the following inputs (e.g., input by user into controller) can be used to control the focal spot. The user can implement command processing. This can include the use of command inputs and lookup/calibration table to determine: Focus Power Supply 1 current, which can be for cathode core focus coils; Focus Power Supply 2 current, which can be for anode core focus coils; Steering Power Supply A current and wave form, which can be for Y-direction beam movement; Steering Power Supply B current and wave form, which can be X-direction beam movement; and Magnetic Control Status. If sources do not energize then feedback can stop system from operating.

Figure 7:
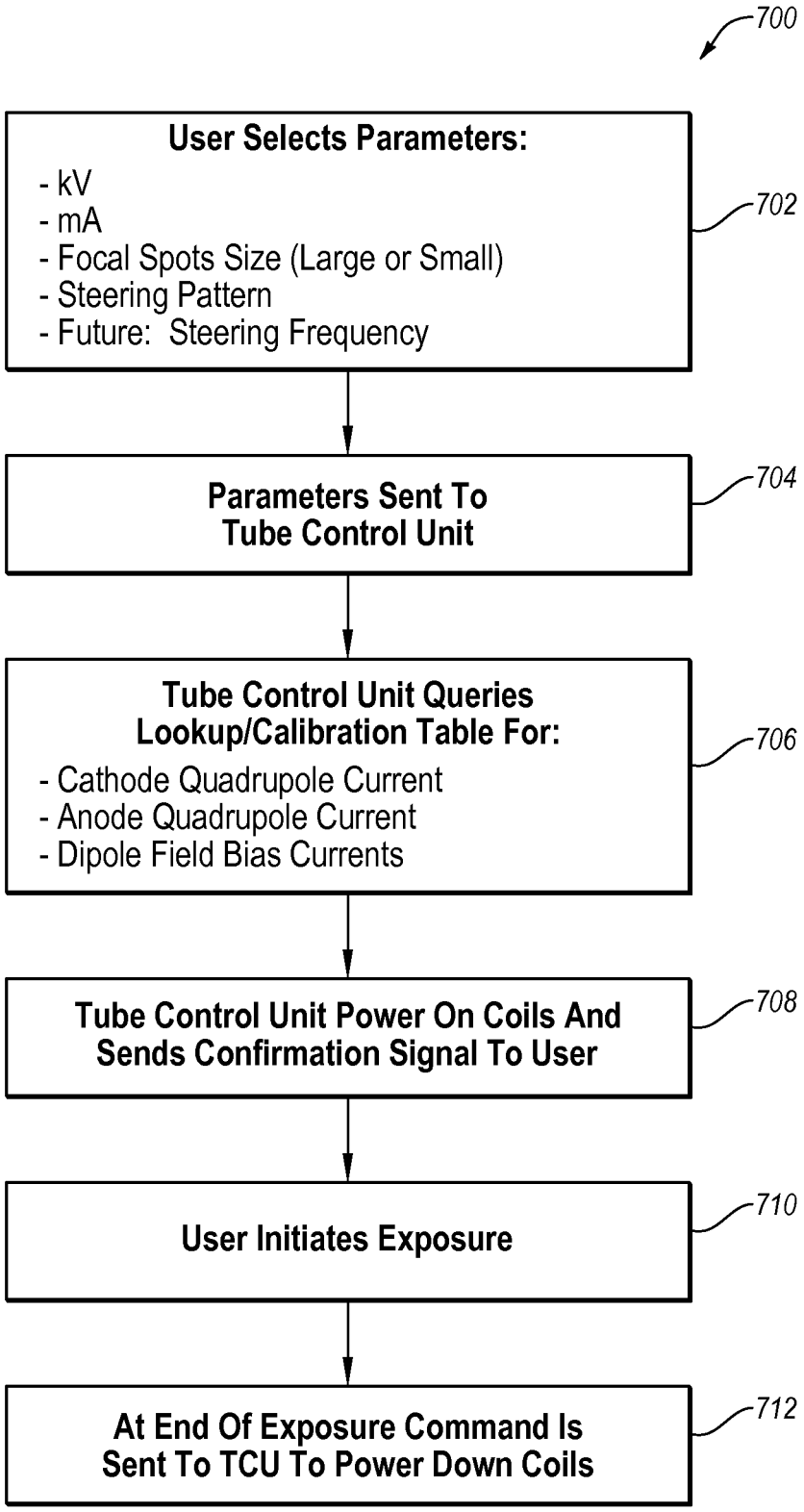
FIG. 7 is a flow chart showing one embodiment of process control for magnet control.

Reference is next made to FIG. 7, which illustrates one example of a methodology 700 for operating the magnetic control functionality denoted in FIGS. 6A-6B. Beginning at step 702, a user may select or identify appropriate operating parameters, which are stored as command inputs in memory 690. At step 704, the operating parameters are forwarded to the tube control unit, which includes command processing unit 676. For each operating parameter, at step 706 the command processing unit 676 queries a lookup/calibration table for corresponding values, e.g., cathode quadrupole current, anode quadrupole current and dipole field bias currents. At step 708, coils are powered on with respective current values, and confirmation is provided to the user. At step 710, the user initiates the exposure and X-ray imaging commences. At completion, step 712, a command is forwarded which causes power to the coils to be ceased.

It will be appreciated that various implementations of the electron beam focusing and steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four first quadrupole pole projections extending from the first quadrupole yoke and oriented toward a central axis of the first quadrupole yoke and each of the four first quadrupole pole projections having a first quadrupole electromagnetic coil; a second magnetic quadrupole between the first magnetic quadruple and the anode and having a second quadrupole yoke with four second quadrupole pole projections extending from the second quadrupole yoke and oriented toward a central axis of the second quadrupole yoke and each of the four second quadrupole pole projections having a second quadrupole electromagnetic coil; and a magnetic dipole between the cathode and anode and having a dipole yoke with four dipole electromagnetic coils.

In one embodiment, an X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam. In one aspect, the magnetic dipole can be configured to deflect the electron beam in order to shift the focal spot of the electron beam on a target. In one aspect, the magnetic dipole have the dipole yoke with four dipole pole projections extending from the dipole yoke that are oriented toward a central axis of the dipole yoke and each of the four dipole pole projections have one of the dipole electromagnetic coils. In one aspect, the four dipole magnetic coils are wrapped around the dipole yoke in an even distribution. In one aspect, the magnetic dipole can have the dipole yoke with four dipole pole projections extending from the dipole yoke and oriented toward a central axis of the dipole yoke, and the dipole magnetic coils are between the dipole pole projections In one embodiment, the four first quadrupole pole projections having the first quadrupole electromagnetic coils are at 45, 135, 225, and 315 degrees; the four second quadrupole pole projections having the second quadrupole electromagnetic coils are at 45, 135, 225, and 315 degrees; and the four dipole electromagnetic coils are at 0, 90, 180, and 270 degrees.

In one embodiment, the four first quadrupole pole projections having the first quadrupole electromagnetic coils are at 45, 135, 225, and 315 degrees; the four second quadrupole pole projections having the second quadrupole electromagnetic coils are at 45, 135, 225, and 315 degrees; and the four dipole electromagnetic coils are at 45, 135, 225, and 315 degrees.

In one embodiment, the X-ray tube has the following order along the emitted electrons: cathode; first magnetic quadrupole (cathode quadrupole); second magnetic quadrupole (anode quadrupole); magnetic dipole; and anode.

In one embodiment, the electron emitter has a substantially planar surface configured to emit electrons in an electron beam in a non-homogenous manner.

In one embodiment, the first magnetic quadrupole can be operably coupled with a first focus power supply; the second magnetic quadruple can be operably coupled with a second focus power supply; a first dipole pair of the magnetic dipole can be operably coupled with a first steering power supply; and a second dipole pair of the magnetic dipole can be operably coupled with a second steering power supply.

In one embodiment, the first magnetic quadrupole can be operably coupled with a first focus power supply; the second magnetic quadruple can be operably coupled with a second focus power supply; and each electromagnet of the magnetic dipole can be operably coupled with a different steering power supply.

In one embodiment, an X-ray tube can include: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and a magnetic dipole configured to deflect the electron beam in order to shift the focal spot of the electron beam on a target, the magnetic dipole configured on a dipole yoke that is separate and different from the second yoke and/or the first and the second yoke.

In one embodiment, a method of focusing and steering an electron beam in an X-ray tube can include: providing the X-ray tube of one of the embodiments; operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the magnetic dipole to steer the electron beam away from the electron beam axis.

In one embodiment, a method of focusing and steering an electron beam in an X-ray tube can include providing the X-ray tube of one of the embodiments, and operating the electron emitter so as to emit the electron beam from the cathode to the anode along an electron beam axis, implementing one or more of the following: operating the first magnetic quadrupole to focus the electron beam in a first direction; operating the second magnetic quadrupole to focus the electron beam in a second direction orthogonal with the first direction; or operating the magnetic dipole to steer the electron beam away from the electron beam axis.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. An X-ray tube comprising:

a cathode including an electron emitter that emits an electron beam;

an anode configured to receive the emitted electrons of the electron beam;

a first magnetic quadrupole between the cathode and the anode and having a first quadrupole yoke with four first quadrupole pole projections extending from the first quadrupole yoke and oriented toward a central axis of the first quadrupole yoke and each of the four first quadrupole pole projections having a first quadrupole electromagnetic coil;

a second magnetic quadrupole between the first magnetic quadrupole and the anode and having a second quadrupole yoke with four second quadrupole pole projections extending from the second quadrupole yoke and oriented toward a central axis of the second quadrupole yoke and each of the four second quadrupole pole projections having a second quadrupole electromagnetic coil; and a magnetic dipole between the cathode and anode and having a dipole yoke with four dipole pole projections and four dipole electromagnetic coils, wherein each dipole pole projection has a dipole electromagnetic coil, wherein the first quadrupole yoke, second quadrupole yoke, and dipole yoke are separate yokes.

2. The X-ray tube of claim 1, comprising:

the first magnetic quadrupole being configured for providing a first magnetic quadrupole gradient for focusing the electron beam in a first direction and defocusing the electron beam in a second direction orthogonal to the first direction;

the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam.

3. The X-ray tube of claim 1, comprising the magnetic dipole being configured to deflect the electron beam in order to shift a focal spot of the electron beam on a target.

4. The X-ray tube of claim 1, comprising the magnetic dipole having the dipole yoke with four dipole pole projections extending from the dipole yoke and oriented toward a central axis of the dipole yoke and each of the four dipole pole projections having one of the dipole electromagnetic coils.

5. The X-ray tube of claim 1, comprising the four dipole electromagnetic coils are wrapped around the dipole yoke in an even distribution.

6. The X-ray tube of claim 5, comprising the magnetic dipole having the dipole yoke with four dipole pole projections extending from the dipole yoke and oriented toward a central axis of the dipole yoke, and the four dipole electromagnetic coils are between the four dipole pole projections.

7. The X-ray tube of claim 1, comprising:

the four first quadrupole pole projections having the first quadrupole electromagnetic coils being at 45, 135, 225, and 315 degrees;

the four second quadrupole pole projections having the second quadrupole electromagnetic coils being at 45, 135, 225, and 315 degrees; and the four dipole electromagnetic coils being at 0, 90, 180, and 270 degrees.

8. The X-ray tube of claim 1, comprising:

the four first quadrupole pole projections having the first quadrupole electromagnetic coils being at 45, 135, 225, and 315 degrees;

the four second quadrupole pole projections having the second quadrupole electromagnetic coils being at 45, 135, 225, and 315 degrees; and the four dipole pole projections having the four dipole electromagnetic coils thereon being at 0, 90, 180, and 270 degrees.

9. The X-ray tube of claim 1, comprising:

the four first quadrupole pole projections having the first quadrupole electromagnetic coils being at 45, 135, 225, and 315 degrees;

the four second quadrupole pole projections having the second quadrupole electromagnetic coils being at 45, 135, 225, and 315 degrees; and the four dipole pole projections being at 0, 90, 180, and 270 degrees.

10. The X-ray tube of claim 9, the cathode having a cathode head surface with one or more focusing elements located adjacent to the electron emitter.

11. The X-ray tube of claim 1, comprising:

the four first quadrupole pole projections having the first quadrupole electromagnetic coils being at 45, 135, 225, and 315 degrees;

the four second quadrupole pole projections having the second quadrupole electromagnetic coils being at 45, 135, 225, and 315 degrees; and the four dipole pole projections and/or the four dipole electromagnetic coils being at 45, 135, 225, and 315 degrees.

12. The X-ray tube of claim 1, wherein the X-ray tube has the following order along the emitted electrons: cathode; first magnetic quadrupole; second magnetic quadrupole, magnetic dipole; and anode.

13. The X-ray tube of claim 1, comprising the electron emitter having a substantially planar surface configured to emit electrons in an electron beam in a non-homogenous manner.

14. The X-ray tube of claim 1, comprising:

the first magnetic quadrupole being operably coupled with a first focus power supply;

the second magnetic quadrupole being operably coupled with a second focus power supply;

a first dipole pair of the magnetic dipole being operably coupled with a first steering power supply; and a second dipole pair of the magnetic dipole being operably coupled with a second steering power supply.

15. The X-ray tube of claim 1, comprising:

the first magnetic quadrupole being operably coupled with a first focus power supply;

the second magnetic quadrupole being operably coupled with a second focus power supply; and each electromagnet of the magnetic dipole being operably coupled with a different steering power supply.

16. The X-ray tube of claim 1, comprising:

two magnetic dipoles that are orthogonal with respect to each other, each of the two magnetic dipoles being configured to deflect the electron beam in order to shift a focal spot of the electron beam on a target, the two magnetic dipoles configured on a dipole yoke.

17. The X-ray tube of claim 1, comprising:

a pair of magnetic dipoles between the cathode and anode and having a dipole yoke with four dipole electromagnetic coils.

18. The X-ray tube of claim 1, comprising a pair of magnetic dipoles being configured together to deflect the electron beam in an X axis and/or Y axis in order to shift a focal spot of the electron beam on a target.

19. A method of focusing and steering an electron beam in an X-ray tube, the method comprising:

providing the X-ray tube of claim 1;

operating the electron emitter so as to emit the electron beam from the cathode to the anode along an electron beam axis;

operating the first magnetic quadrupole to focus the electron beam in a first direction;

operating the second magnetic quadrupole to focus the electron beam in a second direction orthogonal with the first direction; and operating the magnetic dipole to steer the electron beam away from the electron beam axis.

20. An X-ray tube comprising:

a cathode including an emitter that emits an electron beam;

an anode configured to receive the emitted electrons;

a first magnetic quadrupole formed on a first yoke and having a magnetic quadrupole gradient for focusing the electron beam in a first direction and defocusing the electron beam in a second direction perpendicular to the first direction;

a second magnetic quadrupole formed on a second yoke and having a magnetic quadrupole gradient for focusing the electron beam in the second direction and defocusing the electron beam in the first direction;

wherein a combination of the first and second magnetic quadrupoles provides a net focusing effect in both first and second directions of a focal spot of the electron beam; and a pair of magnetic dipoles configured to deflect the electron beam in order to shift the focal spot of the electron beam on a target, the pair of magnetic dipoles formed on a dipole yoke, wherein the first yoke, second yoke, and dipole yoke are separate yokes.

21. A method of focusing and steering an electron beam in an X-ray tube, the method comprising:

providing the X-ray tube of claim 20;

operating the electron emitter so as to emit the electron beam from the cathode to the anode along an electron beam axis;

operating the first magnetic quadrupole to focus the electron beam in a first direction;

operating the second magnetic quadrupole to focus the electron beam in a second direction orthogonal with the first direction; and operating the pair of magnetic dipoles to steer the electron beam away from the electron beam axis.

* * * * *